US005291829A

United States Patent [19]

Avory et al.

[11] Patent Number: 5,291,829

[45] Date of Patent: Mar. 8, 1994

[54] RADIO FREQUENCY ATTENUATING CONNECTOR

[75] Inventors: Mark Avory, Palo Alto; William D. Fahey, Cupertino; Theodore J. Netoff, Milpitas; Pierre R. Irissou, Sunnyvale, all of Calif.

[73] Assignee: Quantic Industries, Inc., San Carlos, Calif.

[21] Appl. No.: 968,358

[22] Filed: Oct. 29, 1992

[51] Int. Cl.[5] ..... F42B 3/18

[52] U.S. Cl. ..... 102/202.2; 102/206; 361/248

[58] Field of Search ..... 102/202.2, 206; 361/247, 248; 439/607

[56] References Cited

U.S. PATENT DOCUMENTS 4,141,297 2/1979 Sellwood ..... 102/206

4,145,968 3/1979 Klein ..... 102/202.2

*Primary Examiner*—Ian J. Lobo

*Attorney, Agent, or Firm*—Burns, Doane, Swecker & Mathis

[57] ABSTRACT

A radio frequency attenuating connector includes a secondary coil connected to a load, an electromagnetic shield enclosing the secondary coil and the load, a primary coil, a coupler for detachably coupling the primary coil and the secondary coil, an integrated circuit including a square wave oscillator producing complementary output signals, and first and second switching devices. The first switching device is responsive to one of the complementary output signals for causing a current to flow in one direction through at least a portion of the primary coil during a first half cycle of oscillation, and the second switching device is responsive to another of the complementary output signals for causing a current to flow in an opposite direction through at least a portion of the primary coil. The integrated circuit has an enable feature and includes additional protection circuitry for enhancing the safety of the radio frequency attenuating connector.

12 Claims, 4 Drawing Sheets

RADIO FREQUENCY ATTENUATING CONNECTOR

BACKGROUND OF THE INVENTION

The present invention relates to electrical connectors and more particularly to a radio frequency attenuating connector (RFAC) for use in ordnance systems.

STATE OF THE ART

Electrically initiated pyrotechnic charges are employed in wide variety of military applications (for example, ejector release mechanisms in aircraft) as well as civil applications (for example, airbag initiators). Safe and reliable operation of electrically initiated pyrotechnic charges requires that the electrical initiation system be highly immune to electromagnetic interference (EMI). An essential requirement is that pyrotechnic charges shall fire only in response to a properly-applied command signal, never as the result of interference from spurious signals. In aircraft, ships and other vehicles where such explosive devices are used, spurious radio frequency signals are often present. Precautions must therefore be taken to ensure that the spurious signals are incapable of supplying sufficient energy to the explosive device to cause ignition.

An ignition circuit designed to provide such protection is disclosed in U.S. Pat. No. 4,141,297. In one configuration of the ignition circuit, shown in FIG. 1 of the present specification, a split coil transformer 1 includes a primary coil 2 and a secondary coil 3. The secondary coil is connected to a heating element 8 of an explosive fuse, the secondary coil 3 and the heating element 8 being enclosed within an electromagnetic shield, or faraday cage. Except for energy inductively coupled from the matching primary coil 2 to the secondary coil 3, radio frequency electromagnetic energy impinging on the protected secondary coil is severely attenuated. Energy is inductively coupled from the primary coil 2 to the secondary coil 3 through a full-bridge inverter circuit including transistors 9, 10, 11, and 12 when a low-level logic signal is applied to a trigger input 17. The inverter circuit receives a DC input voltage of +27 volts and by the switching operation of transistors 9–12 produces an alternating current in the primary coil 2. Transistors 9 and 12 are turned on during one half cycle of operation, causing a current to flow in one direction through the primary coil 2, and transistors 11 and 10 are turned on during a next half cycle of operation, causing a current to flow in an opposite direction through the primary coil 2. Corresponding currents are induced in the secondary coil 3 and heat the heating element 8 to initiation.

Connected to the base of each of the transistors 9–12 is a corresponding tertiary winding 4–7. The tertiary windings are suitably phased to cause self-excitation of the bridge circuit so that it oscillates, thereby producing a square wave output in the range of about 20–50 KHz at the secondary winding 3. Diodes 24 and 25, when conductive, provide low resistance shunts across resistors 26 and 27, respectively, in the biasing circuits of the transistors 9 and 12, respectively. Corresponding diodes 28 and 29 are provided in the base/emitter circuits of the transistors 10 and 11, respectively, so that all the bridge transistors have substantially the same base-to-emitter configurations. Zener diodes 30–33 protect the transistors from transient over-voltages.

The circuit of FIG. 1 performs well its intended function of rejecting spurious signals and allowing the pyrotechnic charge to fire only in response to a properly-applied command signal. The circuit is unduly complicated, however, difficult to manufacture, and hence expensive. Particular care must be taken to achieve correct phasing of the tertiary windings 4–7 such that the conditions for self-oscillation are obtained. Nevertheless, the frequency of such oscillations is not precisely controllable. The four tertiary coils must not only be wound correctly but must be connected to the rest of the circuit, complicating manufacture. Numerous resistors and diodes are required, adding to the complexity and expense of the circuit. Furthermore, the circuit of FIG. 1 is a poor coupler of power and, is inflexible, i.e., not easily adaptable to specialized applications, and since it is sensitive to low voltage, it demonstrates an insufficient level of safety for at least one such application, namely driving laser diodes for initiating ordnance.

What is needed then is a circuit that maintains the high level of protection against spurious RF signals as the circuit of FIG. 1 but that is simpler, easier to manufacture and less expensive, as well as offering increased flexibility and increased safety with respect to low voltages and ground currents sufficient to allow the circuit to be used for driving laser diodes for initiating ordnance.

SUMMARY OF THE INVENTION

According to the present invention, a radio frequency attenuating connector includes a secondary coil connected to a load, an electromagnetic shield enclosing the secondary coil and the load, a primary coil, means for detachably coupling the primary coil and the secondary coil, an integrated circuit including a square wave oscillator producing complementary output signals, and first and second switching means. The first switching means is responsive to one of the complementary output signals for causing a current to flow in one direction through at least a portion of the primary coil during a first half cycle of oscillation, and the second switching means is responsive to another of the complementary output signals for causing a current to flow in an opposite direction through at least a portion of the primary coil during a second half cycle of oscillation. This alternating driving of halves of the primary creates an alternating field which is coupled to the secondary coil. The integrated circuit has an enable feature and includes additional protection circuitry for enhancing the safety of the radio frequency attenuating connector.

BRIEF DESCRIPTION OF THE DRAWINGS

FIG. 2(*b*) is a simplified diagram of a radio frequency attenuating connector according to the present invention;

DETAILED DESCRIPTION OF THE PREFERRED EMBODIMENTS

Figures 2A, 2B:
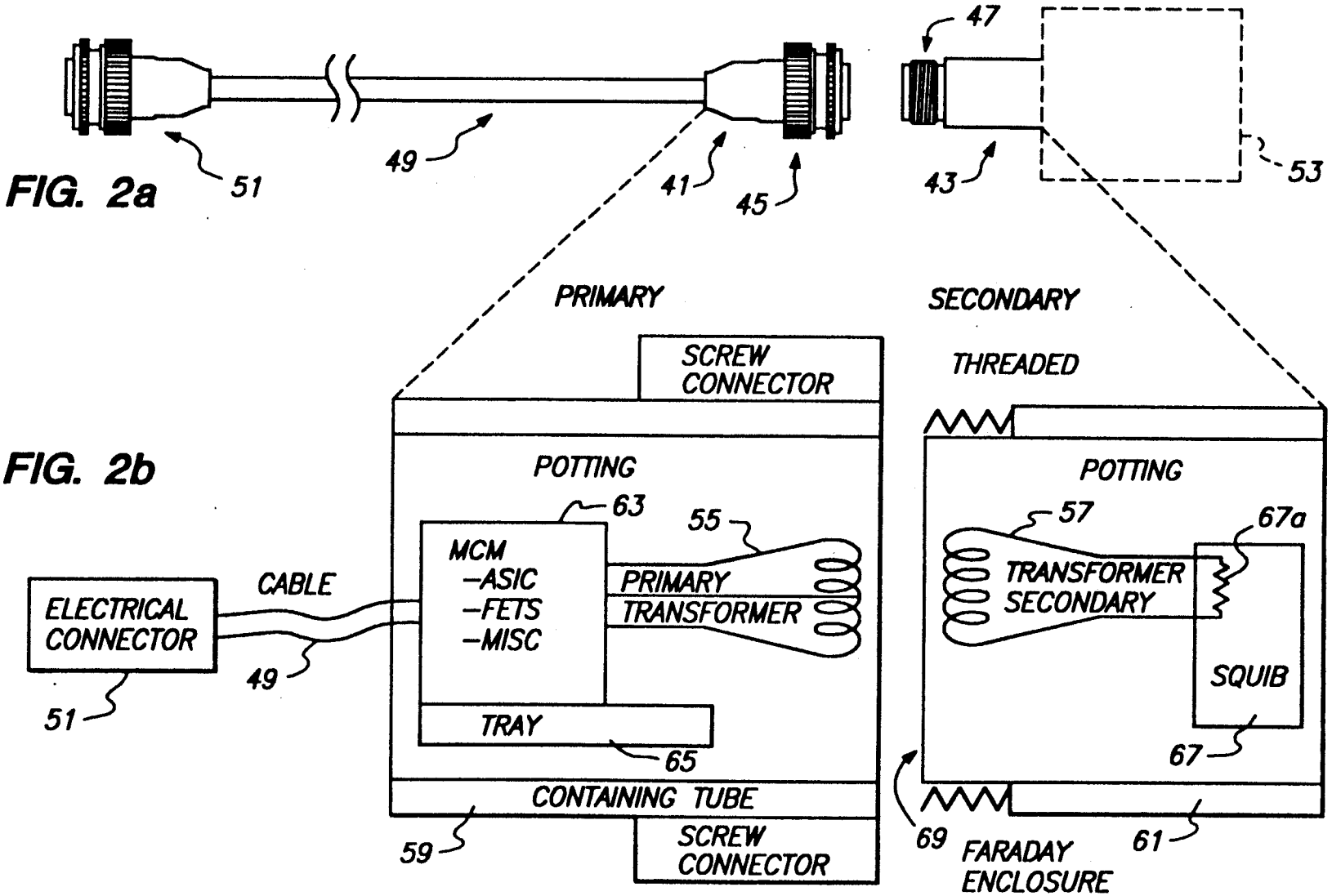
FIG. 2(*a*) is a mainly perspective view of a radio frequency attenuating connector according to the present invention.

Referring now to FIG. 2(*a*), the primary and secondary halves of a split-core transformer of the radio frequency attenuating connector are housed respectively in a primary RFAC housing 41 and a secondary RFAC housing 43. Attached to the primary and secondary RFC housings are mating connector halves 45 and 47. The primary RFAC housing 41 is connected by a cable 49 to another electrical 51 connector for connection to an initiation command unit. The secondary RFAC housing is connected directly to an electrically initiated pyrotechnic device 53, shown in dashed outline. The primary assembly and the secondary assembly are shown in greater detail in FIG. 2(*b*).

Figure 1:
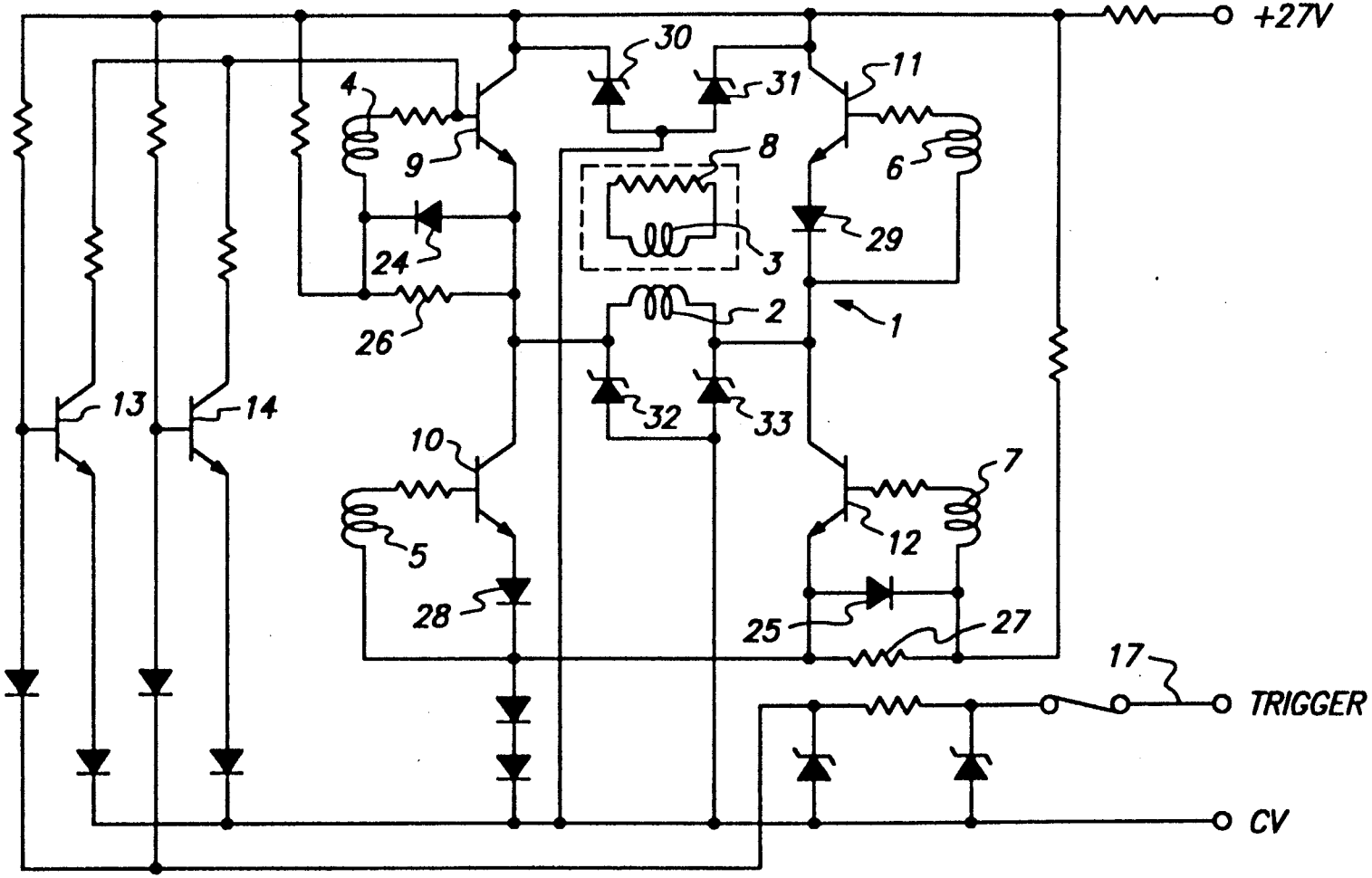
FIG. 1 (PRIOR ART)
FIG. 1 is a schematic diagram of one configuration of an ignition circuit in accordance with the prior art.

Referring to FIG. 2(*b*), the primary and secondary halves (55, 57) of the split core transformer are potted within connectorized containing tubes 59 and 61 forming the primary RFAC housing 41 and the secondary RFAC housing 43 respectively. The potting material may be epoxy resin, for example. In the present radio frequency attenuating connector, the tertiary windings of FIG. 1 are eliminated, eliminating the concern for proper phasing tertiary windings in coupling to the secondary coil. The only coupling of concern is the coupling of the primary winding 55 and the secondary winding 57. A multichip module (MCM) 63 controls energization of the primary winding and includes an application-specific integrated circuit (ASIC), a minimum of two power field effect transistors (FETs) and a few discrete resistors and capacitors. The components of the multichip module 63 are contained in an encapsulated tray 65. The multichip module 63 connects to the cable 49 and to the electrical connector 51.

The secondary winding 57 is connected to a squib 67 including a resisting heating element and an apportioned amount of charge. The squib 67 functions to transform a heating or thermal stimulus, produced by the bridgewire 67*a*, into a pyrotechnic or detonation output pulse. The secondary assembly is completely enclosed by a faraday enclosure formed by the containing tube 61 and by a cupro-nickel-diaphragm 69 fitted across the mating face of the secondary assembly.

Figure 3:
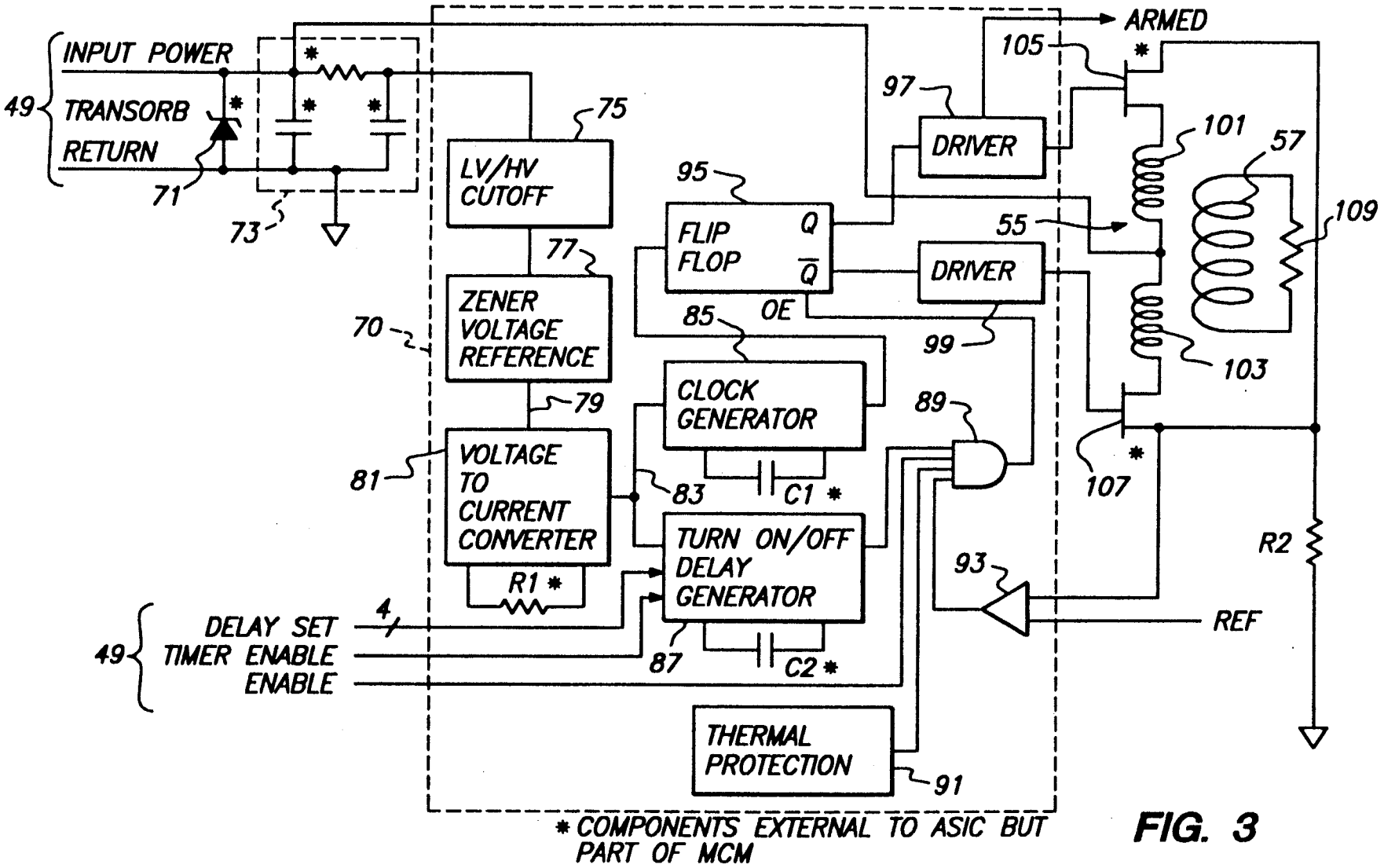
FIG. 3 is a schematic diagram of the multi-chip module of FIG. 2(*b*)

Referring to FIG. 3, showing an electrical schematic of the multichip module, the custom integrated circuit (ASIC) 70 enables a level of intelligence to be incorporated into the radio frequency attenuating connector that greatly enhances its safety and flexibility. Inputs to the integrated circuit 70 from the cable 49 include input power and ground, an ENABLE signal, a TIMER ENABLE signal, and a four-line DELAY SET signal. A transorb 71 and a filter/decoupling circuit 73 protect the integrated circuit 70 against power surges.

Input power filtered by the filter/decoupling circuit 73 is input to a low voltage/high voltage cutoff portion 75 of the integrated circuit 70. Input power to the radio frequency attenuating coupler may vary widely. The integrated circuit 70 is required to operate normally with input voltages ranging from 8 to 36 volts DC. If the applied voltage is less than 8 volts, the cutoff block 75 opens a power supply line, preventing abnormally low power from being supplied to the remainder of the integrated circuit 70 with the possibility of causing abnormal operation. If input power is greater than 42 volts, the cutoff block 75 also opens the power supply line to protect the integrated circuit 70. If input power is within the 8 to 42 volt range, power is connected to a Zener voltage reference 77 that produces a constant operating voltage of about 7 volts. The regulated voltage is supplied on line 79 to a voltage-to-current converter 81 which, in combination with an external resistor, produces a small constant current of a fraction of a milliamp. The current is input to a clock generator 85 and a delay generator 87, each of which requires an external capacitor, C1 and C2 respectively for its operation.

The delay generator implements two separate timing functions, a turn-on delay starting from when current is received from the voltage-to-current converter and a turn-off delay starting from the end of the turn-on delay. To implement the turn-on delay, the delay generator charges the external capacitor C2 to a predetermined level at a rate dependent on the DELAY SET signal. In a preferred embodiment, the four delay set signal lines select between sixteen possible delays set by code selects corresponding individually to delays of 1 ms, 2 ms, 3 ms and 5 ms, respectively. To implement the turn-off delay, the delay generator discharges the external capacitor C2 to a predetermined level at a predetermined rate. In a preferred embodiment, the turn-off delay is about 75 ms. When the TIMER ENABLE signal is low, the turn-off timer is disabled with the effect that the turn-off delay becomes infinite; i.e., once the turn-on delay has been satisfied, the delay generator produces an output signal for so long as it receives power.

The output signal from the delay generator is input to an AND gate 89 together with an ENABLE signal, a thermal overload signal produced by a thermal protection portion 91 of the integrated circuit and an overcurrent signal produced by a comparator 93. The output of the AND gate 89 controls whether or not power is supplied from the primary to the secondary. Accordingly, four conditions must be satisfied for the four-input AND gate 89 to allow power to be supplied from the primary to the secondary.

First, a suitable input power voltage must have been supplied to the integrated circuit for a period of time greater than the turn-on delay and less than the combined turn-on and turn-off delays if the turn-off timer is enabled. Verifying that the input voltage has satisfied the threshold conditions for a programmed period of time protects the ordnance device from low level signals that may accidentally be connected to the input and prevents transients from operating the device. Second, an external ENABLE signal must be applied to the integrated circuit, significantly increasing the safety of the device. Third, the integrated circuit must be below a predetermined abnormally high operating temperature. In the thermal protection portion 91 of the integrated circuit, a temperature-dependant voltage across a diode is compared to a predetermined threshold, and a thermal overload condition is signalled by producing a low output signal from the thermal protection circuit. This feature assures that even in the event of a conflagration (fire on a ship, for example) the device is safe from run-away and inadvertent initiation. Fourth and finally, the current through the primary coil must be less than a predetermined limit. The current through the primary coil is caused to flow through a low-inductance gold-plated resistor R2 to ground, and the voltage R2 across the resistor is compared to a reference voltage to determine if the current limit is exceeded. The system is therefore able to safely handle high-power conditions.

When all of the previous conditions are satisfied, the AND gate 89 produces an output enable signal OE to a flip flop 95. The clock generator 85 inputs a square wave signal to the flip flop 95, the square wave signal having a frequency of about 100 KHz in a preferred embodiment. The flip flop 95 therefore changes states about two hundred thousand times a second, the Q output producing a high level output signal for input to a first driver 97 for one half of the cycle and the Q signal producing a high level output signal for input to a second driver 99 during another half of the cycle. The flip flop is designed such that the Q and the $\overline{Q}$ outputs are never on at the same time, even momentarily. When the first driver 97 is active, it produces a ARMED signal required in some applications to indicate that initiation has begun.

In a preferred embodiment, the primary coil 55 is of the center-tapped type, the center tap being connected to the unfiltered input power. The primary coil 55 is formed by two windings 101 and 103 of approximately 32 turns each. The windings are bobbinless, allowing thicker wire to be used to reduce copper losses. The windings are placed in a recess of a potcore having an E-shaped cross section, the core of the transformer secondary having a matching cross section. Power FETs 105 and 107 are connected from each of the windings, through the current measuring resistor R2, to ground. The FETs are driven at opposite phases by the drivers 97 and 99.

A resistive heating element 109 is connected between the ends of the secondary coil 57. Care is taken to align the matching faces of the primary and secondary transformers such that when the primary and secondary housings (FIG. 2) are fully engaged, any air gap that might potentially exist between the primary and secondary transformers is eliminated. In a preferred embodiment, the connector 45 on the primary housing 41 is spring loaded such that the primary transformer is slightly compliant so as to assume the necessary alignment. Optionally, a capacitor (not shown) may be added to the secondary circuit to provide for tuning of the circuit. The leakage inductance of the secondary coil, the resistive element, and the capacitor together form a resonant tank circuit. The size of the capacitor may be chosen to cause the circuit to resonate at the oscillation frequency, increasing the efficiency of energy transfer between the primary and the secondary and further increasing the safety of the device by decreasing its sensitivity to any frequency but the tuned frequency. This feature is optimized with a fixed frequency source as provided by the clock generator 85 of FIG. 3.

As compared to the prior art circuit of FIG. 1, the present radio frequency attenuating connector enjoys a significantly reduced production cost, significantly increased safety, and offers many new features so as to greatly extend the potential use of the device. A particularly advantageous application of the radio frequency attenuating connector is for driving laser diodes for initiating ordnance. Laser diodes are currently considered unsafe by the ordnance community because of their low voltage operation, which causes them to be unsafe in the presence of ground current and other stray sources of energy. The radio frequency attenuating coupler may be used as a front end to provide a safe environment for the laser diode. This approach isolates the laser diode and, combined with the external enable feature of the radio frequency attenuating coupler, makes their operation safe. The use of the radio frequency attenuating coupler in a system containing a rectifier and laser drive electronics makes the safe and inexpensive use of laser diodes for initiating ordnance a reality.

Figure 4:
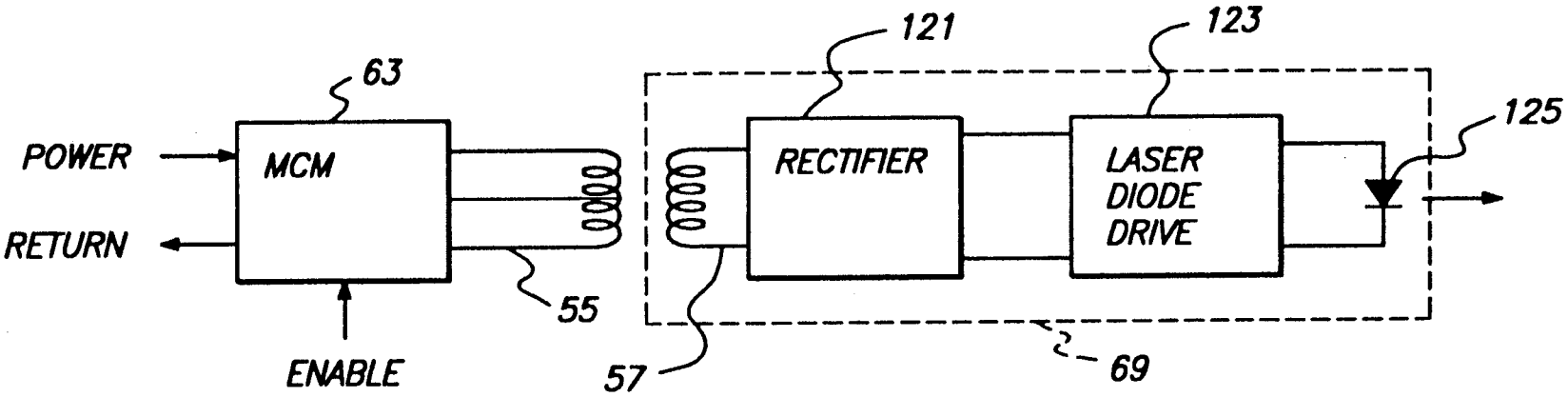
FIG. 4 is a block diagram of an initiation system in which the multi-chip module is used as a front end to a laser diode.

A block diagram of such a system is shown in FIG. 4. The multi-chip module 63 receives a power input and an enable input and has a power return. The multi-chip module causes an alternating field to be produced in the primary coil 55. When the two halves of the RFAC are properly connected and the required power and enable conditions are satisfied, energy is coupled from the primary coil 55 into the secondary coil 57. A rectifier 121 receives an alternating voltage produced across the secondary coil 57 and produces a DC voltage for input to a laser diode driver 123. A laser diode is driven into emission by the driver, providing a light stimulus that may be used to initiate an ordinance device.

The radio frequency attenuating coupler will find wide application in various fields, its flexibility having been increased by the provision of a programmed input delay, a programmed on-time and an external arm signal. The use of the RFAC in a laser diode initiation system represents only one particularly advantageous application thereof.

It will be apparent to those of ordinary skill in the art that the present invention may be embodied in other specific forms without departing from the spirit or essential or central character thereof. The disclosed embodiments are therefore intended in all respects to be illustrative and not restrictive. The scope of the invention is indicated by the appended claims rather than the foregoing description, and all changes which come within the meaning and range of equivalents thereof are intended to be embraced therein.

What is claimed is:

1. A radio frequency attenuating connector, comprising:

a secondary coil connected to a load;

an electromagnetic shield enclosing said secondary coil and said load;

a primary coil;

means for detachably coupling said primary coil and said secondary coil;

an integrated circuit including a square wave oscillator producing complementary output signals;

power driver means responsive to said complementary output signals; and first switching means responsive to said power driver means for causing a current to flow in one direction through at least a portion of said primary coil during a first half cycle of oscillation and second switching means responsive to said power driving means for causing a current to flow in an opposite direction through at least a portion of said primary coil during a second half cycle of oscillation.

2. The apparatus of claim 1 wherein said integrated circuit further comprises means for selectively enabling said square wave oscillator.

3. The apparatus of claim 2 wherein said means for selectively enabling comprises logic means responsive to a logic-level enable signal for enabling said square wave oscillator only when said enable signal is of a specified logical value.

4. The apparatus of claim 3 wherein said means for selectively enabling comprises means for determining when said power input has satisfied a threshold condition continuously for a specified period of time.

5. The apparatus of claim 4 wherein said logic means is responsive to an activation signal produced by said means for determining for enabling said square wave oscillator only when said activation signal is of a specified logical value.

6. The apparatus of claim 5 wherein said means for determining comprises means for changing said activation signal from said specified logical value to an opposite logical value when said activation signal has had said specified logical value for a specified period of time.

7. The apparatus of claim 6 wherein said means for determining further comprises means responsive to a delay set signal for causing said activation signal to be produced after a variable delay selected according to said delay set signal.

8. The apparatus of claim 7 wherein said means for determining further comprises override means responsive to a timer enable signal for causing said activation signal to have said specified logical value for so long as said power input satisfies said threshold condition when said timer enable signal is of a specified logical value.

9. The apparatus of claim 3 wherein said means for selectively enabling comprises means for generating a thermal overload signal when a temperature of a portion of said integrated circuit becomes excessive, said logic means being responsive to said thermal overload signal to disable said square wave oscillator;

wherein said load is part of an ignitor for a pyrotechnic device, and said means for generating a thermal overload signal provides protection against fire igniting said pyrotechnic device.

10. The apparatus of claim 3 wherein said means for selectively enabling comprises means for sensing current through said primary coil and for generating an over-current signal when said current is excessive, said logic means being responsive to said over-current signal to disable said square wave oscillator.

11. The apparatus of claim 1 wherein said load is a laser diode.

12. The apparatus of claim 1 further comprising means for tuning the secondary coil using a capacitor, thereby increasing efficiency of power transfer from the primary coil to the secondary coil.

* * * * *